US006098612A

United States Patent [19]

Nakamoto et al.

[11] Patent Number: 6,098,612

[45] Date of Patent: Aug. 8, 2000

[54] HEATING GARMENT

[75] Inventors: Mitsuyoshi Nakamoto, Nara; Shinichi Nakajima, Takatsuki; Toshinari Matsumoto, Toyonaka; Takaaki Kusaka, Akashi, all of Japan

[73] Assignee: Matsushita Electric Industrial Co., Ltd., Osaka, Japan

[21] Appl. No.: 08/860,528

[22] PCT Filed: Oct. 29, 1996

[86] PCT No.: PCT/JP96/03161

§ 371 Date: Sep. 4, 1997

§ 102(e) Date: Sep. 4, 1997

[87] PCT Pub. No.: WO97/16083

PCT Pub. Date: May 9, 1997

[30] Foreign Application Priority Data

| | | | |
|---|---|---|---|
| Oct. 30, 1995 | [JP] | Japan | 7-281260 |
| Oct. 30, 1995 | [JP] | Japan | 7-281261 |
| Nov. 10, 1995 | [JP] | Japan | 7-292376 |

[51] Int. Cl.[7] ..... A61F 7/00

[52] U.S. Cl. ..... 126/204; 126/208; 431/328

[58] Field of Search ..... 126/204–208, 126/210; 431/328, 329, 344

[56] References Cited

U.S. PATENT DOCUMENTS

| | | | |
|---|---|---|---|
| 3,110,301 | 11/1963 | Bricker . | |
| 3,159,158 | 12/1964 | Baker | 126/208 |
| 3,315,658 | 4/1967 | Kamitani et al. . | |
| 3,457,908 | 7/1969 | Hamatani et al. | 126/208 |
| 5,062,222 | 11/1991 | Billet et al. . | |

FOREIGN PATENT DOCUMENTS

| | | |
|---|---|---|
| 0014300 | 5/1979 | European Pat. Off. . |

*Primary Examiner*—James C. Yeung
*Attorney, Agent, or Firm*—McDermott, Will & Emery

[57] ABSTRACT

A heating garment includes a heat source provided inside a garment, and a heat conducting path for transmitting air heated by the heat source from the heat source upwardly along a back of the garment. By so doing, not only can a portable, light-weight and compact combustor be provided, but the use of this combustor is effective to accomplish heating inside the garment while the supply of fuel and the amount of heat supplied can be controlled, to thereby provide a comfortable temperature environment inside the garment. It is also possible to obtain the heating garment ready comfortably and quick to warm.

17 Claims, 11 Drawing Sheets

HEATING GARMENT

FIELD OF TECHNOLOGY

The present invention relates to a portable combustor, and a heating garment utilizing the same, which can be used in highlands and/or cold districts or on the sea where the supply of a power an/or gas is hardly available.

BACKGROUND ART

As a portable combustor, gas stoves and body warmers utilizing a petroleum fuel as a source of energies are currently widely used. The gas stoves are dangerous because of the open fire system and have a low heating efficiency because most of the thermal energies produced are emitted to the atmosphere. On the other hand, the body warmers are merely capable of warming a locality of the body of the user.

Accordingly, heating garments and heating mats have been suggested which incorporate an electric battery and an electric resistance element distributed inside the garment or mat. However, the currently available electric battery exhibits a low energy density for a unit weight thereof and is incapable of supplying heat to the heating garment and heating mat for a substantial length of time. If the heating garment or mat is desired to be heated for a substantial length of time with a sufficient amount of heat, the battery would become so bulky and so heavy that the battery can no longer be used for portable use.

The Japanese Laid-open Patent Publication No. 4-347450 (corresponding to the U.S. Pat. No. 5,282,740) discloses a heating garment in which a petroleum fuel having an energy density far higher than that afforded by the electric battery is catalytically combusted to provide heat with which a fluid such as water is heated to a proper temperature and is then circulated inside the garment.

As a means for accomplishing heating inside the garment by the utilization of combustion heat, body warmers of a kind utilizing fuel such as alcohol or charcoal and disposable body warmers of a kind utilizing a chemical reaction between a ferrous material and an oxidized material are also currently available. Yet, a camp stove utilizing a cassette filled with butane is also known as a combustor utilizing fuel. The camp stove is generally referred to as a cordless appliance because no line cord is used and is generally used as a heat source for cooking.

In any event, the prior art portable combustors have a problem in that they are heavy and have a large volume. Of them, the heating garment comprising the combustor in which the combustor of a type utilizing a liquid medium such as water as a heat catalyst and this heat source is connected through a tubing with a medium to be heated has a problem in that the heating garment is heavy and lacks flexibility.

In addition, the prior art body warmers are merely capable of heating a locality and are incapable of heating over a large area inside the garment. The body warmer is inconvenient to use since when the fuel such as alcohol or charcoal is to be refilled the body warmer must be removed out of the garment. When it comes to the disposable body warmers, not only are they ineffective to be reused, but also they have the heat quantity that cannot be controlled during heating to a desired temperature.

The camp stoves are in the form of the combustor integrated together with a fuel tank and an operating console and cannot be used for heating inside the garment even though they are mounted inside the garment. In addition, because the operating console and the combustor are integrated together, not only is it impossible to control the combustion from outside of the garment, but also the heat quantity cannot be controlled while the user wears the garment.

Accordingly, the present invention is intended to provide a combustor which is light-weight and compact in size and conveniently portable, to make it possible to heat the garment over the entire area by the use of the combustor of the type referred to above, and to make it possible to adjust the supply of fuel and the amount of heat supplied to thereby create a comfortable temperature distribution inside the garment.

DISCLOSURE OF THE INVENTION

In order to accomplish these and other objects of the present invention, there is provided a heating garment which comprises first and second fabrics sewn together, a heat source interposed between the first and second fabrics, and a heat conducting path formed in the first and second fabrics for guiding air heated by the heat source upwardly between the first and second fabrics.

Preferably, a porous flexible sheet is interposed between the first and second fabrics, in which case the heat conducting path referred to above is formed by a multiplicity of pores in the porous flexible sheet for guiding the heated air by convection. The porous flexible sheet may be of a skeleton structure in which a multiplicity of pores are open-celled, or in the form of a mesh or a cotton quilting and is preferably stitched to the rear of one of the first and second fabrics which serves as an outer fabric.

Specifically, the heating garment may comprise a cloth including first and second fabrics sewn together, a combustor disposed at a predetermined portion between the first and second fabrics and including a heat generating element adapted to be heated by combustion of fuel, and a heat conducting medium disposed between the first and second fabrics and thermally coupled with the heat generating element for distributing by convection heat of the heat generating element between the first and second fabrics. The heat generating element may be provided with a plurality of heat radiating fins.

Preferably, the combustor comprises a housing constituted by the heat generating element and having a combustion chamber defined therein, a fuel injection nozzle fluid-connected with a fuel supply source and disposed so as to confront the combustion chamber, an igniting device disposed so as to confront the combustion chamber for igniting the fuel supplied into the combustion chamber, a suction tube for introducing from outside to a portion adjacent the nozzle air which is to be mixed with the fuel, injected through the nozzle, to form an air-fuel mixture, and an exhaust tube for discharging an exhaust gas, produced as a result of the combustion of the air-fuel mixture, to the outside. A catalyst may be disposed in a portion of the combustion chamber downstream of the nozzle with respect to the direction of flow of the fuel injected by the nozzle.

The heat conducting textile fabric is preferably in the form of a woven fabric made up of one of polyester and copper threads forming a weft and the other of the polyester and copper threads forming a warp.

BEST MODE FOR CARRYING OUT THE INVENTION

First Embodiment—FIGS. 1 to 5

Figure 1:
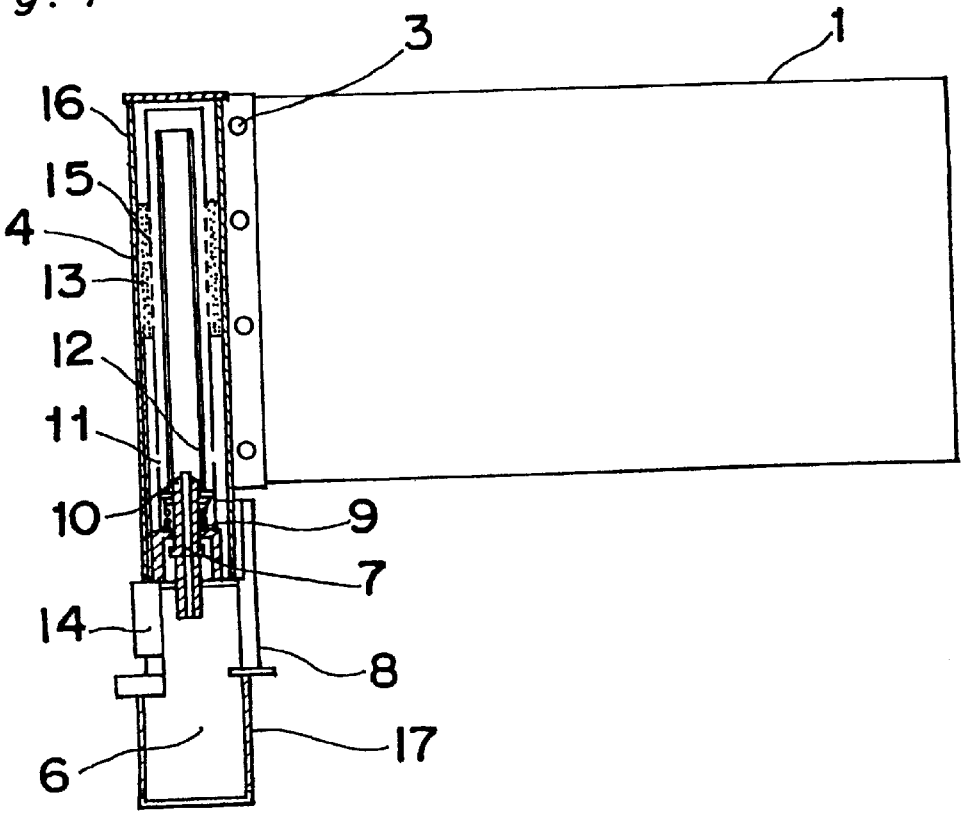
FIG. 1 is a plan view of a heater-incorporated mat according to a first embodiment of the present invention.
Figure 2:
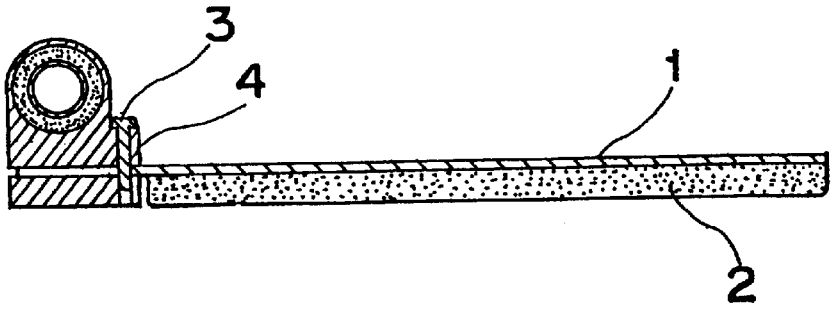
FIG. 2 is a longitudinal sectional view of the heater-incorporated mat shown in FIG. 1.

With particular reference to FIGS. 1 and 2, a first embodiment of the present invention will be described. Shown in FIGS. 1 and 2 is a portable heater-incorporated mat including a heating sheet 1 and a heat generating element 4. The heating sheet 1 is made up of a heat conductive textile fabric which may be a woven fabric woven by the use of aluminum-plated glass yarns having a high heat diffusion property, a woven fabric containing carbon fibers, a woven fabric containing natural or synthetic yarns formed with a layer of metallic particles dispersed in a flexible resinous binder, a woven fabric made up of metallic fibers, or a woven fabric woven by the use of metallic fibers and fibers other than the metallic fibers. The heating sheet 1 has a rear surface joined together with a heat insulating fabric 2. This heat insulating fabric 2 is made of fiber material having a high heat insulating property and made of, for example, fibers generally used as a heat insulating material. The heating sheet 1 has one end to which the heat generating element 4 is joined. This connection is accomplished by the use of connecting screws 3 through which the heating sheet 1 is firmly sandwiched in and held in tight contact with the heat generating element 4. For the heat generating element 4, a gas catalytic combustor 17 including a combustion catalyst 13 and an igniting device 14 is employed.

The gas catalytic combustor 17 is of the following construction. A fuel gas container 6 is provided with a gas sluice valve 7 which can be selectively opened and closed by means of a sluice knob 8, but is normally biased towards a closed position by a spring 9. When the sluice knob 8 is manipulated so as to open, a fuel gas discharged from the fuel gas container 6 is jetted from a fuel injection nozzle 10 and flows within an ejector 12 together with air sucked in through an air intake port 11 by the effect of a suction force developed by the flow of the jetted fuel gas. The ejector 12 has a wall formed with a plurality of injection ports 15 through which a gaseous mixture of the fuel and the air is supplied onto a combustion catalyst 13. This ejector 12 is accommodated, together with the combustion catalyst 13 and the igniting device 14, within a tubular protective housing 16 for protecting the combustion catalyst 13.

The operation of the first embodiment of the present invention will now be described. When the sluice knob 8 is manipulated to open the gas sluice valve 7, a fuel gas within the fuel gas container 6 is jetted from the gas injection nozzle 10 and is subsequently mixed with the air sucked in through the air intake port 11 to provide a combustible air-fuel mixture. When at this time the igniting device 14 is activated, the air-fuel mixture starts flame combustion to instantaneously heat the combustion catalyst 13 to a temperature at which the catalytic combustion takes place. In this way, heat evolved by the catalytic combustion is uniformly radiated from the tubular protective housing 16 to heat the heat generating element 4. Since the heat generating element is held in tight contact with the heating sheet 1, heat evolved from the heat generating element 4 is assuredly transmitted to the heating sheet 1. Also, since the heating sheet 1 is made of the heat conductive fabric, the heat evolved from the heat generating element 4 can be efficiently transmitted to the entire surface of the heating sheet 1. The heating sheet 1 has the heat insulating fabric 2 of a high heat insulating property joined thereto and, therefore, the quantity of heat escaping from the rear of the heating sheet 1 is extremely small.

Accordingly, the heating sheet 1 as a whole is heated and maintained at a proper temperature and can be used as a heating mat. It is to be noted that since this heating mat has a high flexibility, it can be used, for example, as wrapped around the human body.

Figure 3:
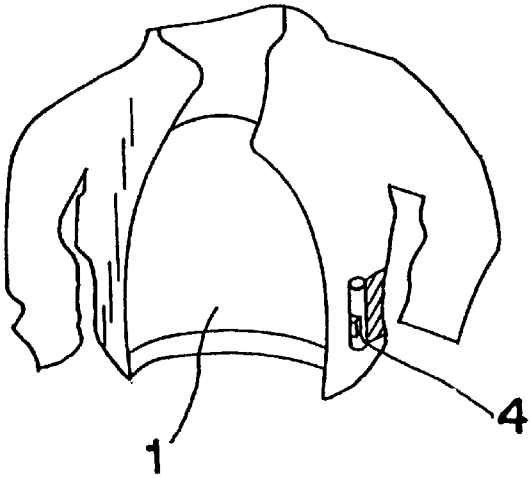
FIG. 3 is a schematic perspective view showing application of the heater-incorporated mat of FIG. 1 to a cloth.

If as shown in FIG. 3, the heating sheet 1 is used as a portion of a clothing, a heating garment can be obtained and can be used in highlands and/or cold districts or on the sea where the supply of a power an/or gas is hardly available.

The foregoing embodiment of the present invention provides a portable heater-incorporated mat which is, as compared with the prior art structure in which the liquid medium such as water is used to heat the member to be heated which is coupled with the heat source by means of a tubing, of a structure very simple, light-weight and flexible.

Figure 4:
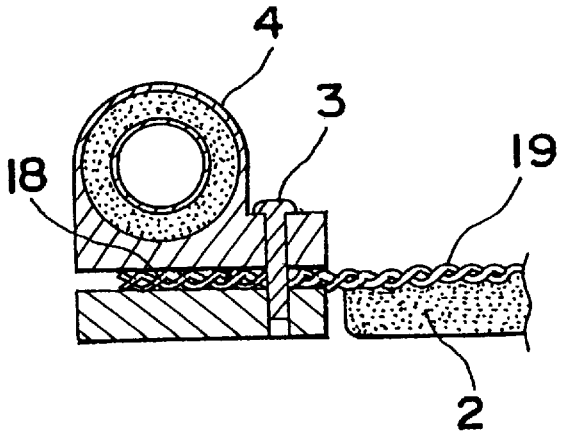
FIGS. 4 and 5 are fragmentary sectional views showing different modifications of a heater shown in FIG. 1, respectively.

If, however, as shown in FIG. 4, the heat generating element 4 is connected with a portion of the heating sheet 1 through a heat conductive material 18 such as, for example, a heat conductive compound or thermo-grease, the heater-incorporated mat capable of exhibiting an increased heating efficiency can be obtained. In other words, transmission of heat between the heat generating element 4 and the heating sheet 1 takes place efficiently and, accordingly, the heat evolved by the heat generating element 4 can assuredly be transmitted to the heating sheet 1. In such case, the fuel consumption will be decreased, allowing the heater-incorporated mat to be used for heating for an increased length of time.

Figure 5:
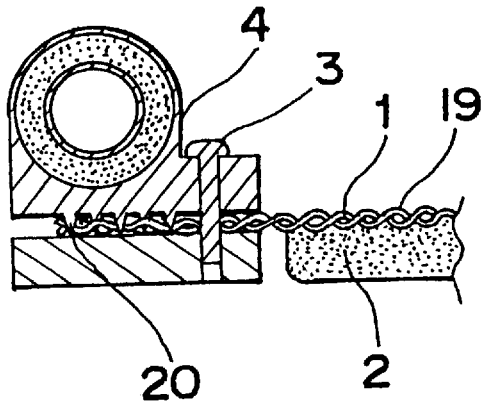

Alternatively, if as shown in FIG. 5 at least one of the mating surfaces of the heat generating element 4 and the heating sheet 1, for example, the surface of the heat generating element 4 which is held in contact with the heating sheet 1, is formed with a plurality of projections 20 and heat conducting fibers are sandwiched therebetween in the form as twined around the projections 20, the surface area of contact between the heat generating element 4 and the heating sheet 1 can further be increased and, accordingly, the heat of the heat generating element 4 can be efficiently transmitted to the heating sheet 1.

Figure 6:
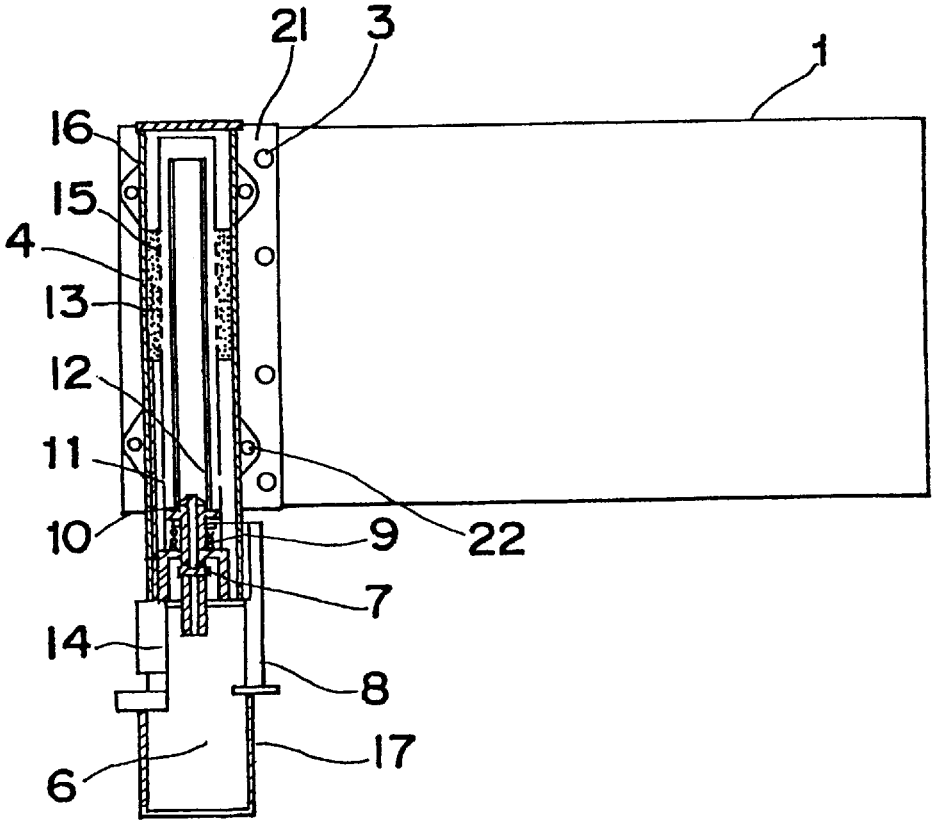
FIG. 6 is a plan view of the heater-incorporated mat according to a second embodiment of the present invention.
Figure 7:
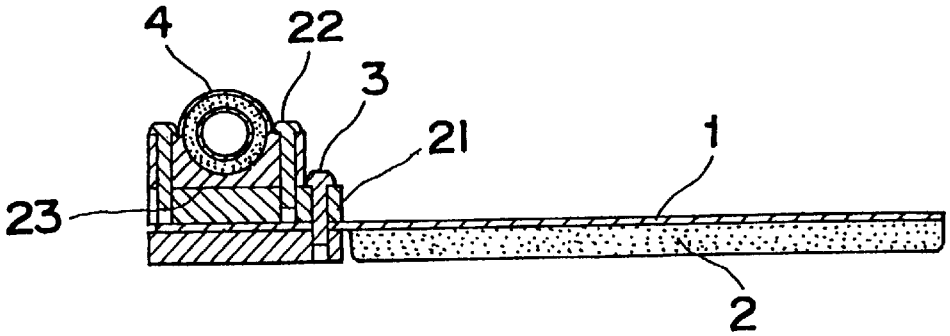
FIG. 7 is a longitudinal sectional view of the heater-incorporated mat shown in FIG. 6.
Figure 8:
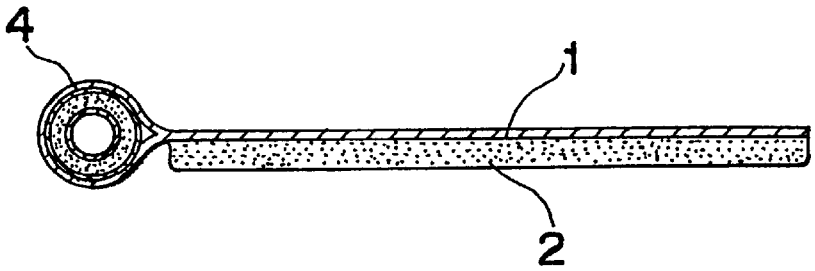
FIG. 8 is a longitudinal sectional view showing a modification which can be applied to the heater-incorporated mat according to any one of the first and second embodiments of the present invention.

Second Embodiment—FIGS. 6 to 8

The heater-incorporated mat according to the second embodiment of the present invention will now be described with reference to FIGS. 6 and 7. A retaining base 21 for the heat generating element is made of a metal of a high thermal conductivity such as, for example, aluminum or copper, and a portion of the heating sheet 1 is secured thereto in the form as sandwiched by means of connecting screws 3. The heat generating element 4 is secured to the retaining base by means of set screws 22.

The heater-incorporated mat according to the second embodiment of the present invention functions in a manner substantially identical to the heater-incorporated mat according to the foregoing embodiment. However, since in the second embodiment of the present invention the heating sheet 1 is partly secured to the retaining base 21 by means of the connecting screws 3, heat emitted from the tubular protective housing 16 that is uniformly heated by the heat from the heat generating element 4 as a result of combustion can assuredly be transmitted to the heating sheet 1. Also, the heating sheet 1 is made of heat conductive fibers and, as shown in FIG. 7, the heat insulating fabric 2 such as fibers is secured to the rear surface of the heating sheet 1. For this reason, the heater-incorporated mat according to this embodiment is of a portable, light-weight and flexible structure as is the case with the heater-incorporated mat according to the foregoing embodiment.

According to this second embodiment of the present invention, since the heat generating element 4 is retained on the retaining base 21, the heat generating element 4 can be easily separated to enable the heater-incorporated mat to be easily serviced.

Referring particularly to FIG. 7, if the mating surfaces of the heat generating element 4 and the retaining base 21 are mirror-polished as indicated by 23, tight contact between the heat generating element 4 and the retaining base 21 can be enhanced so that a heating appliance having a further increased heating efficiency can be obtained.

It is to be noted that in any one of the first and second embodiments of the present invention the heat generating element 4 can be of a structure wherein as shown in FIG. 8 the heat generating element 4 is wrapped around by the adjacent end portion of the heating sheet 1. In such case, the heat evolved from the heat generating element will hardly be discharged to the outside and can be, substantially in its entire quantity, transmitted to the heating sheet 1 to accomplish the heater-incorporated mat of an extremely high heating efficiency.

Figure 9:
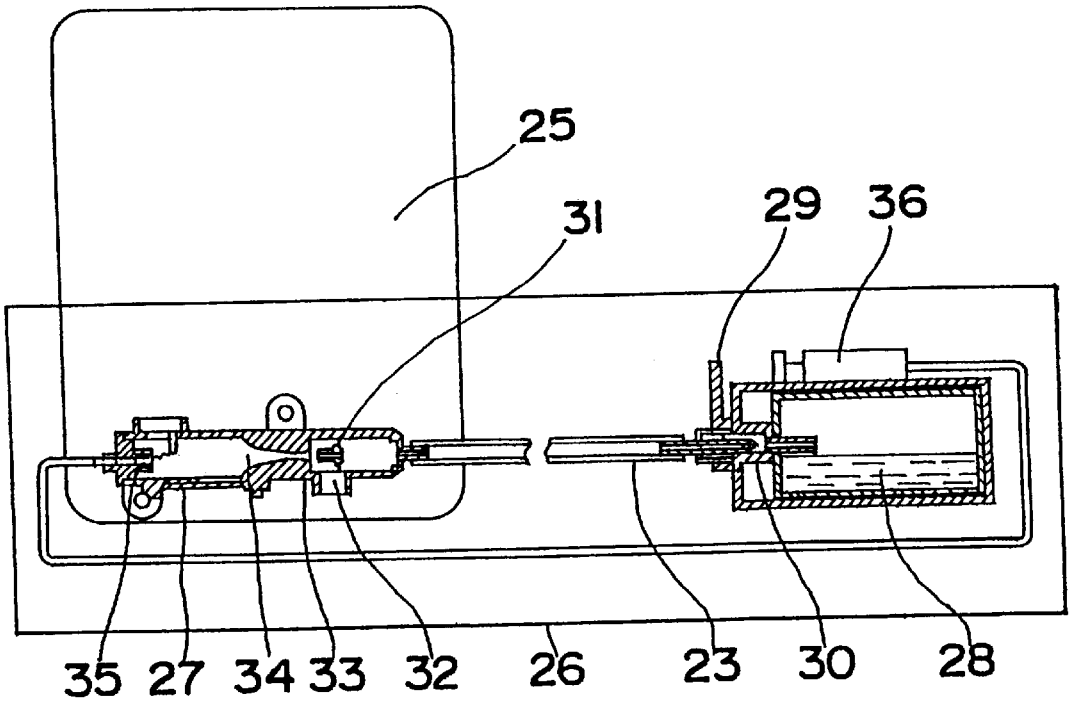
FIG. 9 is a plan view, with a portion shown in section, of the heater-incorporated mat according to a third embodiment of the present invention.
Figure 10:
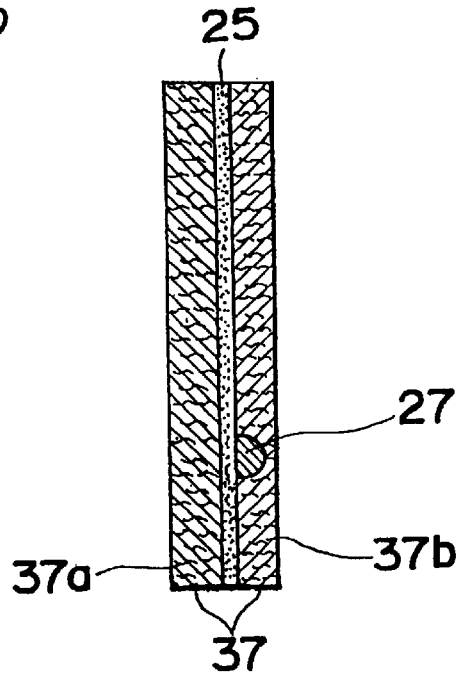
FIG. 10 is a schematic sectional view of the heater-incorporated mat shown in FIG. 9.

Third Embodiment—FIGS. 9 and 10

Referring particularly to FIG. 9 showing the third embodiment of the present invention, reference numeral 25 represents a heating sheet for warming the human body which is made up of a heat conductive material of a high heat conductivity such as, for example, a metallic foil, a metallic mesh or a heat conducting textile fabric. The heat conducting textile fabric may be, for example, a woven fabric woven by the use of aluminum-plated glass yarns having a high heat diffusion property, a woven fabric containing carbon fibers, a woven fabric containing natural or synthetic yarns formed with a layer of metallic particles dispersed in a flexible resinous binder, a woven fabric made up of metallic fibers, or a woven fabric woven by the use of metallic fibers and fibers other than the metallic fibers. A portion of the heating sheet 25 is coupled with a heat generating element 27 of a combustor 26.

The combustor 26 is of the following construction. A fuel gas container 28 is provided with a gas sluice valve 30 which can be selectively opened and closed by means of a sluice knob 29. A fuel gas discharged from the fuel gas container 28 as a result of manipulation of the knob 29 is jetted from a fuel injection nozzle 7 and flows within an ejector 12 together with air sucked in through an air intake port 32 by the effect of a suction force developed by the flow of the jetted fuel gas. Reference numeral 34 represents a discharge port through which an air-fuel mixture discharges. Reference numeral 35 represents an ignition needle for providing a spark when an igniting device 36 is actuated.

As shown in FIG. 10, heat insulating layers 37*a* and 37*b* are fitted to respective opposite surfaces of the heating sheet 25 so as to cover the entire surface thereof. In particular, the heat insulating layer 37*b* covers the heat generating element 27 as well. The heat insulating layers 37*a* and 37*b* serve to suppress heat radiation from the heat generating element 27 and the heating sheet 25, respectively, to enable the heat from the heat generating element 27 to be efficiently transmitted to the heating sheet 25.

The operation of the third embodiment of the present invention will now be described. When the sluice knob 29 as shown in FIG. 9 is manipulated to open the gas sluice valve 30, a fuel gas within the fuel gas container 28 is jetted from the gas injection nozzle 31. This gas flows within an ejector 33 together with air sucked in through the air intake port 32 to provide a combustible air-fuel mixture which is subsequently injected through the discharge port 34. When during this condition the igniting device 36 is activated, the spark is emitted from the ignition needle 35 to ignite the air-fuel mixture, causing the latter to undergo combustion. The resultant combustion heat heats the heat generating element 27. Since the heat generating element 27 is provided in a portion of the heating sheet 1, heat evolved from the heat generating element 27 is transmitted to the heating sheet 1. Since the heating sheet 25 is made of the heat conductive material and is covered by the heat insulating material 37 as shown in FIG. 11, the heat from the heat generating element can be efficiently transmitted to the entire surface of the heating sheet 25.

The foregoing third embodiment of the present invention provides a portable heater-incorporated mat which is, as compared with the prior art structure in which the liquid medium such as water is used to heat the member to be heated which is coupled with the heat source by means of a tubing, of a structure very simple, light-weight and flexible.

Figure 11:
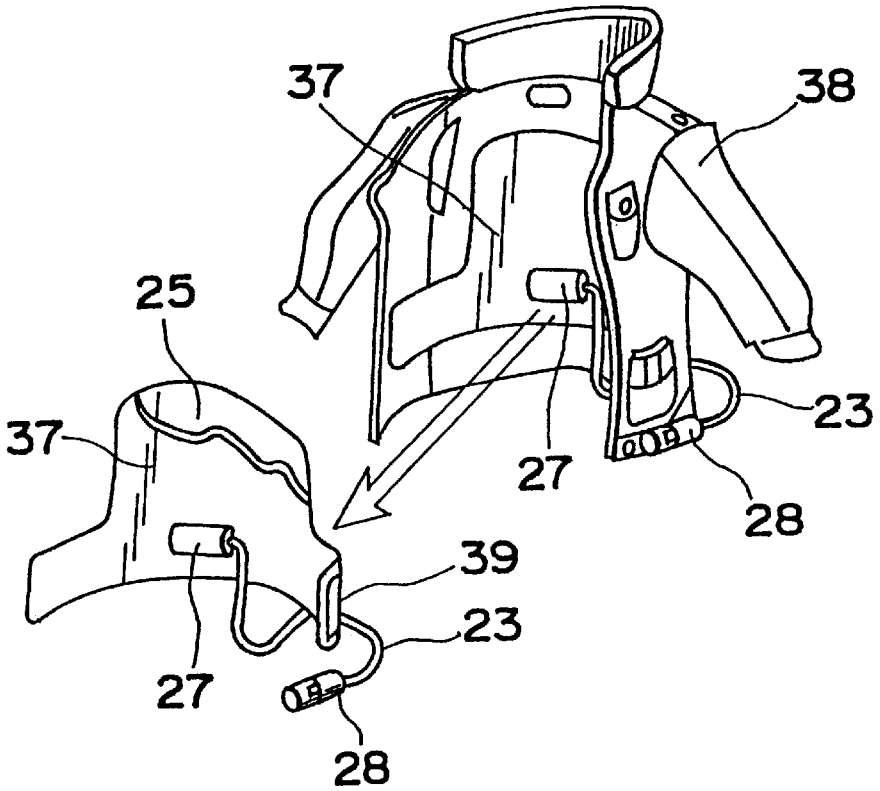
FIG. 11 is a schematic exploded view of a heater-incorporated cloth according to a fourth embodiment of the present invention.

Fourth Embodiment—FIG. 11

FIG. 11 illustrates the fourth embodiment of the present invention. According to this fourth embodiment, the heater-incorporated mat which has been shown in and described with reference to FIGS. 9 and 10 in connection with the third embodiment of the present invention is utilized to provide a heater-incorporated garment, for example, clothing. In order for the heater-incorporated mat to be used in the clothing 38, the heating sheet 25 is provided with releasable connectors 39 through which the heater-incorporated mat can be detachably fitted to a portion of an inner surface of the clothing 38. The releasable connectors 39 may be employed in the form of a flexible planar fastener, a standard fastener or zipper or buttons.

Hereinafter, the operation of the fourth embodiment of the present invention will be described. As is the case with the operation described in connection with the third embodiment of the present invention, the fuel gas within the fuel gas container 28 is mixed with the air and is subsequently burned to heat the heat generating element 27, and the resultant heat from the heat generating element 27 is efficiently transmitted to the heating sheet 1 in its entirety by means of the heat conductive material. Since the combustor is provided inside the clothing 38 to heat the interior space of the clothing 38, the wearer in a cold district can gain a gently warmed feeling. Also, since the combustor is provided with the releasable connectors 39 to allow the heater-incorporated mat to be removed from the clothing 38 when so desired, the heating sheet 25 can be separated from the clothing 38 when the ambient temperature is not so low or when no heating is required because the wearer is going to enjoy exercise.

As hereinabove described, this fourth embodiment of the present invention is effective to provide the easy-to-use heater-incorporated garment in which the heating sheet 25 can be removed when the necessity occurs.

Specifically in the fourth embodiment of the present invention, of the heat insulating layers secured to the opposite surfaces of the heating sheet 25, the heat insulating layer 37*b* is so positioned as to confront the clothing and has a heat insulating property higher than that of the other heat insulating layer 37*a* which is so positioned as to confront the body of the wearer. This can be implemented by making the heat insulating layer 37*b* with a textile material having a higher heat insulating property than that for the heat insulating layer 37*a* or by rendering the heat insulating layer 37*b* to have a greater thickness than that of the heat insulating layer 37*a*. Thus, the difference in heat insulating property between the heat insulating layers 37*a* and 37*b* confronting the garment and the body of the wearer, respectively, that is, the feature in that the heat insulating layer 37*b* confronting the garment has a higher heat insulating property than that of the heat insulating layer 37*a* confronting the wearer's body, is effective to suppress emission of the heat of the heating sheet 25 to the atmosphere on one hand and, on the other hand, the heat of the heating sheet 25 can be centered on the wearer's body to accomplish an efficient heating of the wearer.

As hereinabove described, the fourth embodiment of the present invention is effective to provide the heater-incorporated garment capable of exhibiting an increased heating efficiency, in which temperature of the heating sheet 25 can be uniformly distributed and a higher heat radiation is directed towards the wearer's body than towards the outside of the garment.

Figure 12:
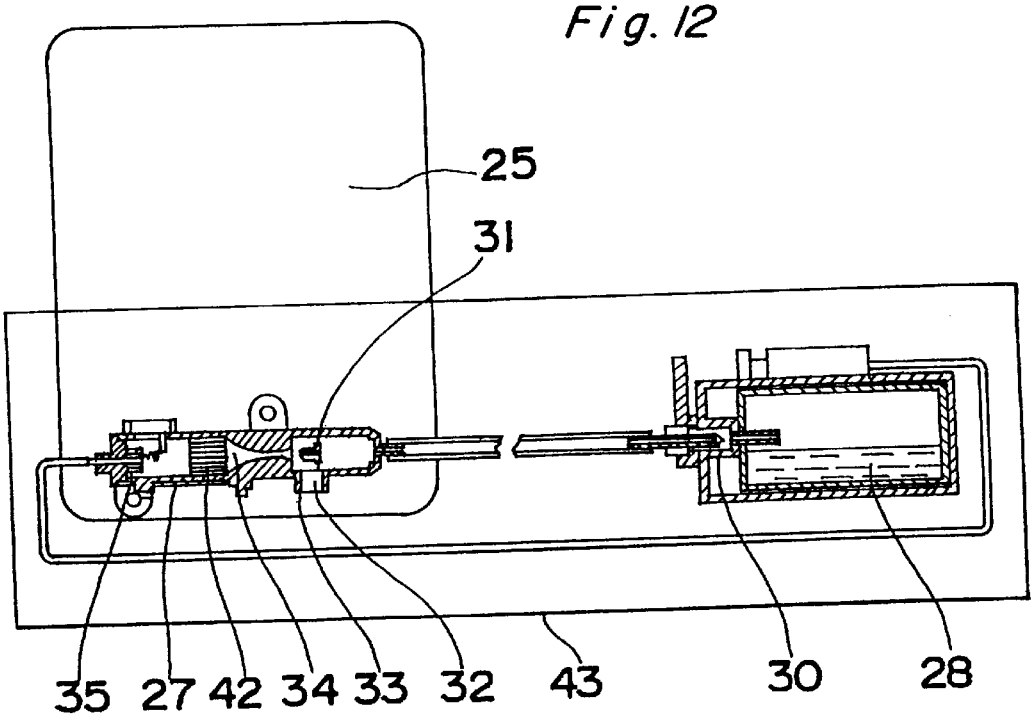
FIG. 12 is a plan view, with a portion shown in section, of the heater-incorporated mat according to a fifth embodiment of the present invention.

Fifth Embodiment—FIG. 12

In this fifth embodiment of the present invention, the combustor employed in any one of the first to fourth embodiments of the present invention is so designed as to function as a catalytic combustor 43 by providing the combustor with a combustion catalyst 42 at a position adjacent the discharge port 34 of the combustor. Except for this difference, that is, the use of the combustion catalyst 42, the combustor employed in the fifth embodiment is substantially similar to that employed in any one of the foregoing embodiments and, therefore, the details thereof will not be reiterated for the sake of brevity.

The operation of this fifth embodiment of the present invention will now be described. When the sluice knob 29 is manipulated to open the gas sluice valve 30, a fuel gas within the fuel gas container 28 is jetted from the gas injection nozzle 31. This gas flows within the ejector 33 together with air sucked in through the air intake port 32 to provide a combustible air-fuel mixture which is subsequently injected through the discharge port 34. When at this condition the igniting device 36 is activated, the spark is emitted from the ignition needle 35 to ignite the air-fuel mixture, causing the latter to undergo a flame combustion. By this flame combustion, the combustion catalyst 42 is instantaneously heated to a temperature required to accomplish a catalytic combustion. In this way, the catalytic combustion results in heating of the heat generating element 27. Since the heat generating element 27 is provided in a portion of the heating sheet 25, the heat from the heat generating element 27 is transmitted to the heating sheet 25. Accordingly, considering that the heating sheet 25 is made of the heat conductive material, the heat of the heat generating element 27 can effectively transmitted to the whole of the heating sheet 25.

Since in this fifth embodiment the combustor is provided with the combustion catalyst 42, normal combustion takes place regardless of the orientation in which the combustor is disposed. Also, the temperature at which the catalytic combustion takes place is lower than the temperature at which the flame combustion takes place and, therefore, the fifth embodiment of the present invention is particularly suited as a heater that is used in the vicinity of the human body.

As described above, this fifth embodiment provides the heater-incorporated mat having no directionality and suited for warming the human body.

Figure 13:
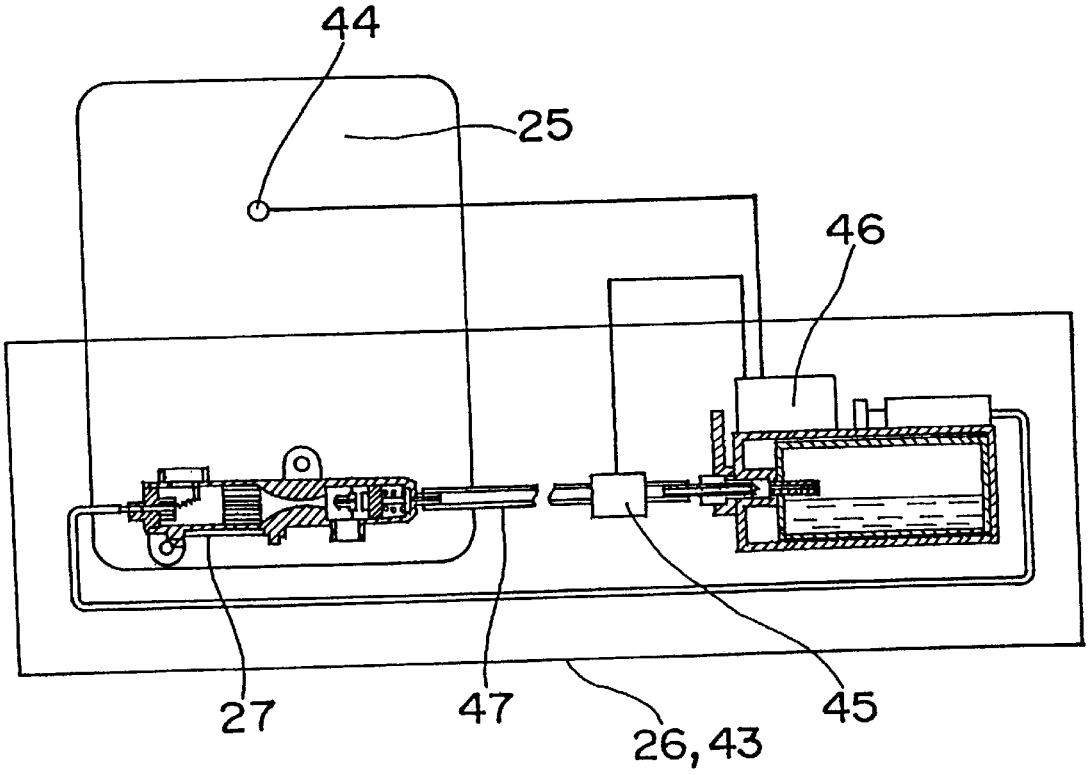
FIG. 13 is a plan view, with a portion shown in section, of the heater-incorporated mat shown in FIG. 12.

A modified form of the fifth embodiment of the present invention is shown in FIG. 13 in which a temperature sensor 44 is disposed in a portion of the heating sheet 25 of the heater-incorporated mat shown in and described with reference to FIG. 12 and, on the other hand, a control valve 45 for regulating the flow of the fuel gas and a controller 46 for controlling the control valve 45 are provided in the combustor 26 or the catalytic combustor 43.

Although in describing the foregoing embodiments of the present invention, the combustor has been described as employed in the form of the heater-incorporated mat, it can be so designed as to be usable as a warming appliance for maintaining a predetermined temperature or as to concurrently serve as a heater and a warmer.

Sixth Embodiment—FIGS. 14 to 17

Figure 14:
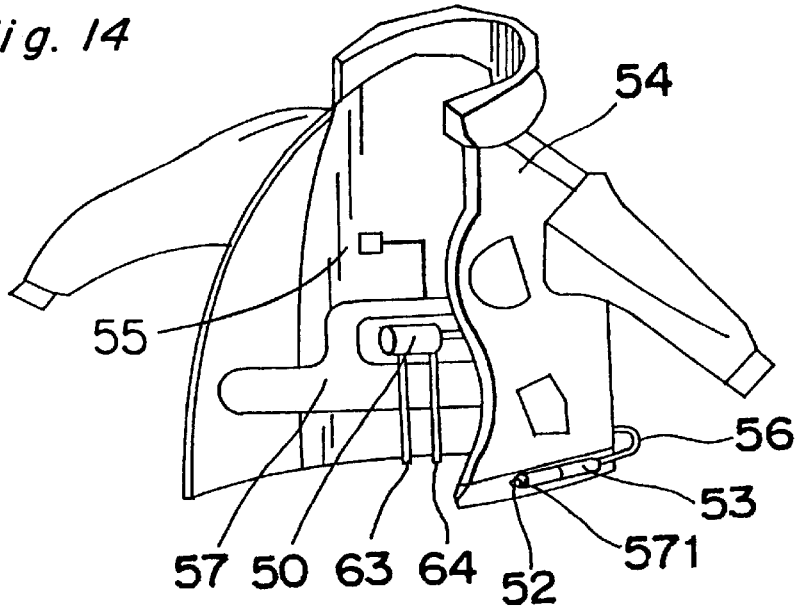
FIG. 14 is a schematic perspective view of the heater-incorporated cloth according to a sixth embodiment of the present invention.

The heater-incorporated garment, for example, clothing is shown in FIG. 14. The combustor used in the heater-incorporated clothing comprises a heat source unit 50 utilizing a combustion heat as a heat source, a control unit for controlling the combustion heat produced by the heat source unit 50, an operating unit 52 for transmitting to the control unit an instruction, for example, a temperature setting, for controlling the combustion taking place in the heat source unit 50, and a fuel container 53 for accommodating a quantity of fuel for the heat source unit 50. The heat source unit 50 is separate from any one of the control unit 51, the operating unit 52 and the fuel container 53 and is mounted in the clothing 54. The heat source unit 50 is fitted to a heat radiating member 57 which is in turn releasably fitted to an inner surface of the clothing 54. The heat source unit 50 is coupled with the control unit, the operating unit 52 and the fuel container 53 by means of a flexible tubing 56. The heat source unit 50 is also communicated with an air intake port 63 and an exhaust port 64.

A garment-side detecting means 55 for detecting a temperature, a humidity and the like is provided inside the clothing 54 and temperature information and the like detected by the garment-side detecting means 55 are transmitted to the control unit by means of a signal line.

Figure 15:
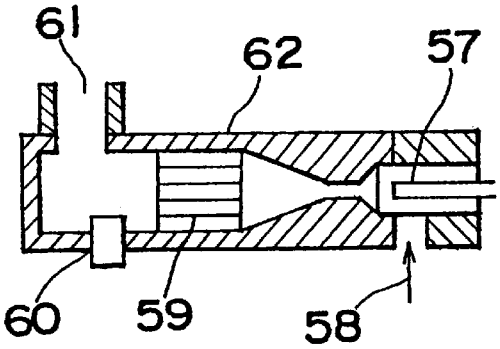
FIG. 15 is a schematic sectional view of the heater used in the heater-incorporated cloth of FIG. 14.

The details of the heat source unit 50 are shown in FIG. 15. Fuel supplied from the fuel container 53 through the tubing 56 is jetted from a fuel nozzle 571. The fuel so jetted is mixed with a combustion air 58 sucked in through the air intake port 63 to form an air-fuel mixture which is subsequently burned in a combustion unit 59. An ignitor 60 protruding into the combustion unit 59 ignites the air-fuel mixture within the combustion unit 59. Reference numeral 61 represents an outlet port of a combustion chamber through which an exhaust gas formed as a result of the port combustion is guided towards the exhaust port 64. Air heated by an outer wall 62 of the combustion unit 59, which is, as shown in FIG. 15, fitted to and thermally coupled with the heat radiating member 57, and also by the heat radiating member 57 flows convectively within the clothing 54. Although the heat can circulate within the clothing 54 even by natural convection to a certain extent, circulation of the heated air by a fan is more effective to accomplish heating. An electric power source for the ignitor 60 and the fan may be at least one battery.

Figure 16:
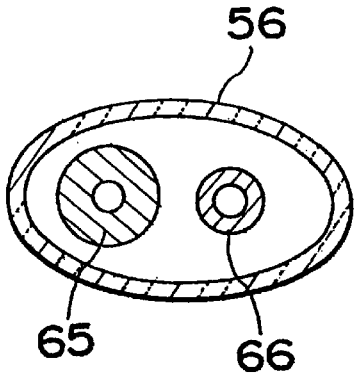
FIG. 16 is a schematic sectional view of a tube employed in the heater-incorporated cloth of FIG. 14.

FIG. 16 illustrates a cross section of the flexible tubing 56. This flexible tubing 56 has a fuel lumen 65 and an operating lumen 66 both defined therein. The fuel lumen 65 is used for the flow of the fuel in a gaseous phase. The operating lumen 66 is used to accommodate an electric wiring for ignition purpose or an electric wiring for control purpose, but where both of the electric wirings are employed in the operating lumen 66, the both should be sufficiently insulated from each other by the use of, for example, an insulating rubber.

Figure 17A:
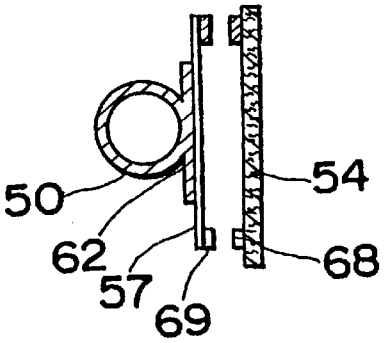
FIGS. 17(*a*) and 17(*b*) are schematic sectional views showing the heater, used in the heater-incorporated cloth of FIG. 14, before it is fitted to the cloth and after it has been fitted to the cloth, respectively.
Figure 17B:
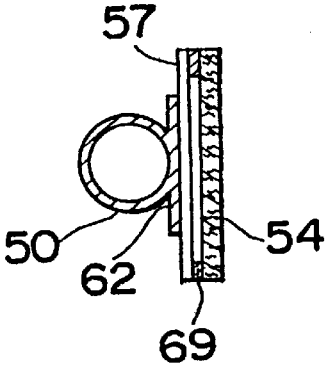

FIGS. 17(*a*) and 17(*b*) illustrate respective sections of the heat source unit 50 and the clothing 54 before and after mounting, respectively. As shown in FIG. 17(*b*), one side of the heat source unit 50 adjacent the clothing 54 is provided with a heat source mounting member 69 and the clothing is provided with a clothing mounting member 68, so that when the heat source mounting member 69 and the clothing mounting member 68 are mated together or engaged with each other, the heat source unit 50 can be fitted to the clothing 54. A similar mounting member is also disposed on the operating unit 52 and the fuel container 53. Clothing mounting members are also provided at a plurality of locations for supporting the operating unit 52 and/or the fuel container 53 so that the operating unit 52 and/or the fuel tank 53 can be fitted to respective location accessible to wearer's hand for manipulation or convenient to accommodate.

When the operating unit 52 is operated to cause fuel to be supplied from the fuel container 53, the fuel is supplied through the tubing 56 to the heat source unit 50. The fuel may be butane or propane or a mixture thereof and is accommodated within the fuel container 53 in a liquid phase. While the fuel container 53 of a small volume is desirable for transportation, a substantial length of time available for the combustion is desirable and, therefore, the fuel tank 53 is chosen to have a capacity of about 14 grams of butane.

The fuel supplied to the combustion unit 59 is in a gaseous phase and the fuel jetted from the fuel nozzle 571 is mixed with the air 58 sucked in through the air intake port 63 to provide the air-fuel mixture which is, when ignited, burned within the combustion unit 59 to produce a combustion heat, Most of the heat so produced undergoes a heat exchange in contact with the outer wall 62 of the combustion unit and a combustion gas so heat-exchanged is reduced in temperature and then discharged through the exhaust port 64.

The fuel when stored is in a liquid phase and is vaporized when emerging outwardly from the fuel container 4. By the effect of a heat of vaporization, the temperature lowers. The lower the temperature, the higher the speed at which the fuel is jetted from the fuel nozzle 571. However, the temperature of the fuel increases under the influence of heat outside the tubing 56 as it flows through the tubing 56 and will attain normal temperatures at the fuel nozzle 571 accompanied by an increase in speed at which the fuel is jetted from the fuel nozzle 571 and, accordingly the combustion air 58 can be sufficiently sucked in.

The combustion air 58 is sucked in through the air intake port 63. If this air intake port 63 is supported outside the clothing 54, a fresh air can be sucked in. The combustion gas is discharged through the exhaust port 64 and, for this reason, this exhaust port 64 is disposed outside the clothing 54. If both of the air intake port 63 and the exhaust port 64 are disposed outside the clothing 54, and even though the wind strikes the clothing 54, the wind also strikes the ports 63 and 64 at the same velocity and, therefore, a stable combustion is possible without being adversely affected by the wind.

The heat exchanged in contact with the outer wall 62 of the combustion unit 59 is transmitted in part to the heat radiating member 57. The heat radiating member 57 is made of a highly flexible material having a high heat conductivity such as, for example, high heat conducting fibers or metallic fibers. In order to avoid the possibility that the heat so transmitted will contact the wearer's body directly, it is covered with a heat insulating material such as fibers or insulating material. A portion of the heat allows the outer wall 62 of the combustion unit 59 to heat air which subsequently flows upwardly by the effect of natural convection within the clothing 54 to warm up the clothing entirely. The heat quantity necessary for heating varies depending on the insulating characteristic of the clothing 54, the outside temperature and the type of a person who wears the clothing 54, it may be approximately 50 Kcal/h. This corresponds to the amount of heat dissipated by the human living. However, this heat quantity may be smaller in the early spring, but would be required to be high when the outside temperature decreases down to −20° C.

Even though natural convection allows the heat to be circulated within the clothing 54, circulation of the heated air by a fan is more effective to accomplish heating. An electric power source for the ignitor 60 and the fan may be at least one battery.

If the heat source unit 50 is fitted to a portion of the clothing 54 which corresponds to the back of the wearer, the wearer can feel comfortable even when the wearer is warm. Also, where it is fitted to a portion of the clothing 54 which will align with the back of the wearer above his or her waist, recesses will be formed which provide a space between the clothing and the body of the wearer and, therefore, the heat can find an easy way to circulate. On the other hand, if the operating unit 52 and the fuel container 53 are fitted at places accessible to the wearer's hand, not only is it easy to manipulate, but the amount of the fuel remaining and the refill can easily be accomplished. Also, it is recommended to accommodate the operating unit 52 and the fuel container 53 at respective locations easy to accommodate them at any occasion other than when the amount of the fuel remaining is desired to be checked and/or manipulated. For this reason, the operating unit 52 and the fuel container 53 are provided with a mounting member (not shown). This mounting member is provided in a plurality of location in the clothing which may be considered convenient for accommodation and manipulation. It will accordingly readily be understood that the heat source unit 50 is preferably installed separate from the operating unit and the fuel container. In particular, where manipulation is desired, the operating unit 52 and the fuel container 53 have to be installed outside the clothing or within clothing pockets, but where accommodation is desired, they have to be installed within the clothing pockets or inside the clothing. On the other hand, it appears advantageous for the heat source unit 50 to be installed within an interior of the clothing in terms of the efficiency of utilization of the heat. Since the respective positions of the operating unit 52 and the fuel container 53 change, the tubing 56 must have a flexibility.

Assuming that the heat source unit 50 is mounted in the clothing 54 and the user wearing this clothing 54 walks or exercises, the heat source unit 50, the operating unit 52, the fuel container 53 and the garment-side detecting means 55 displace from their original positions. For this reason, the tubing 56 must have a flexibility and/or a sufficient length. Also, it must be robust against bending. Since fuel lumen 63 is used for the flow of butane, propane or a mixture thereof, a rubber hose flexible and resistant to pressure is employed therefor. A high voltage electricity for ignition and/or an electric line for controlling the controller extend within the operating lumen 64. For this reason, the operating lumen 64 is employed in the form of a rubber member having an electrically insulating property and also a flexibility.

The heat source unit 50 and both of the operating unit 52 and the fuel container 53 are provided with the releasable mounting members 69 so that they can be released. This permits them to be separated from the clothing when no heating is needed. Also, it is convenient when the clothing is to be washed.

Although in the foregoing embodiment the use has been made of the operating unit and the control unit to control the combustion taking place in the heat source unit, the combustion in the heat source unit can be controlled if, for example, the operating unit is so designed as to have a capability of controlling the amount of the fuel to be supplied from the fuel container to the heat source unit and, also, if the operating unit is provided with a high voltage generating unit, ignition is possible by activating the ignitor of the heat source unit. Also, the operating unit may be provided with a display unit through which an igniting condition of the heat source unit can be ascertained and, in such case, if the operating unit is disposed so as to be operated from outside the garment, the igniting condition thereof can easily be ascertained while the user wears the garment on and, after having been ignited by the operating unit, the igniting condition can be ascertained through the display unit.

Figure 18:
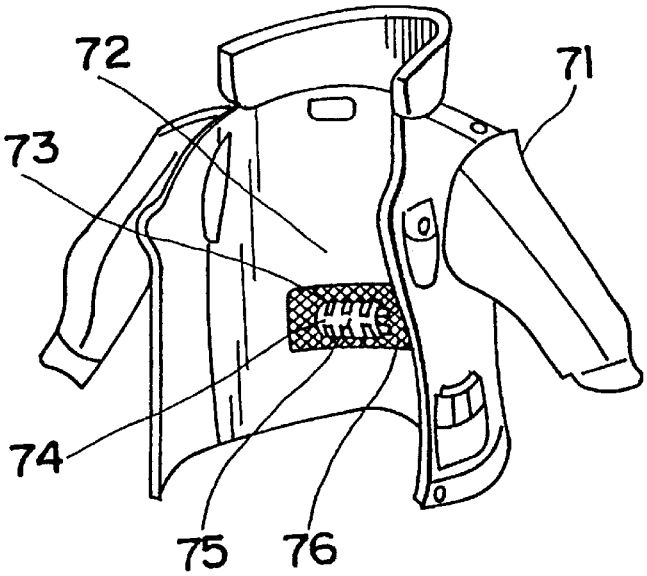
FIG. 18 is a schematic perspective view of the heater-incorporated cloth according to a seventh embodiment of the present invention.
Figure 19:
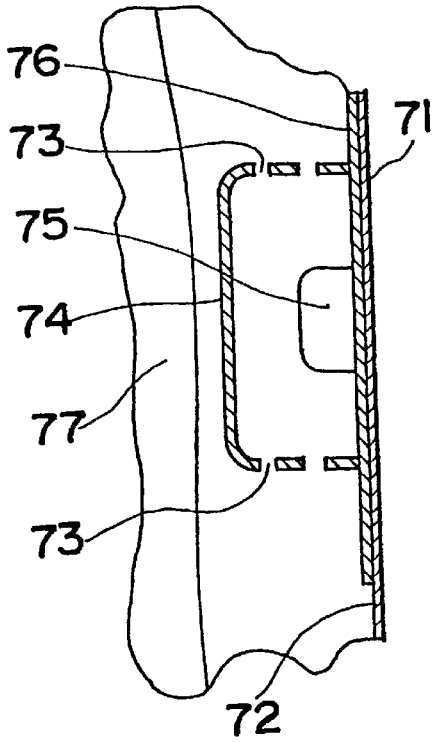
FIG. 19 is a fragmentary sectional view, on an enlarged scale, of the heater used in the heater-incorporated cloth of FIG. 18.

Seventh Embodiment—FIGS. 18 and 19

The seventh embodiment of the present invention will be described with reference to FIGS. 18 and 19 which illustrate, in section, the entire structure of the heater-incorporated garment and the heat source unit used therein, respectively. Referring to these figures, reference numeral 71 represents a clothing. Reference numeral 72 represents an inner back of the clothing 71 to which a heat source 75 wrapped by a heat insulating casing 74 having convection paths 73 defined therein is fitted through a fitting member 76. High heat conductive fibers such as copper fibers may be used in the fitting member 76 to facilitate radiation of heat from the heat source 75. Also, the heat source 75 may be wither a body warmer or a chemical heating material, or may be a catalytic combustor which will be hereinafter described. The heat insulating casing 74 is made of a heat resistant synthetic resin such as, for example, nylon and serves to avoid a contact between the heat source 75 and the back 77 of the user when the latter wears the clothing 71. Since the heat insulating casing 74 is protruding, a gap is formed between the back 77 of the wearer and the inner back 72 of the clothing. When the heat source 75 heats air inside the heat insulating casing 74, an ascending current is generated and heated air is discharged through the convection paths 73 so as to flow upwardly through the gap. At this time, the heated air heats the back 77 of the wearer. In this way, this embodiment of the present invention is so structured as to heat the air to accomplish heating and, by using a material having a good heat dissipating property for the fitting member, a heating effect quick in set-up can be exhibited. It is recommended to provide the heat source 75 with fins for increasing the contact surface area to thereby increase the amount of heat radiated.

Figure 20:
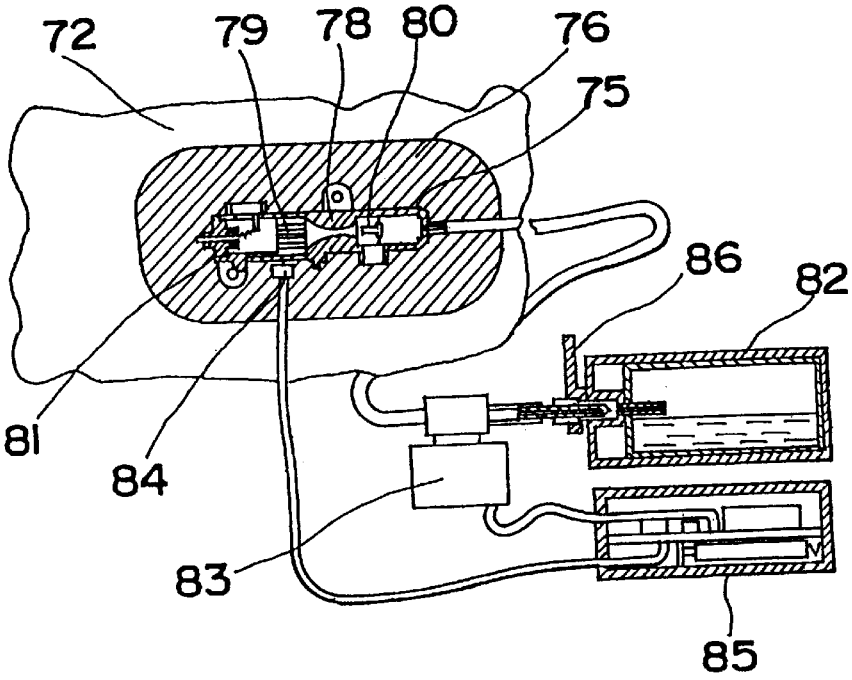
FIG. 20 is a schematic sectional view showing the heater in the heater-incorporated cloth according to an eighth embodiment of the present invention.
Figure 21:
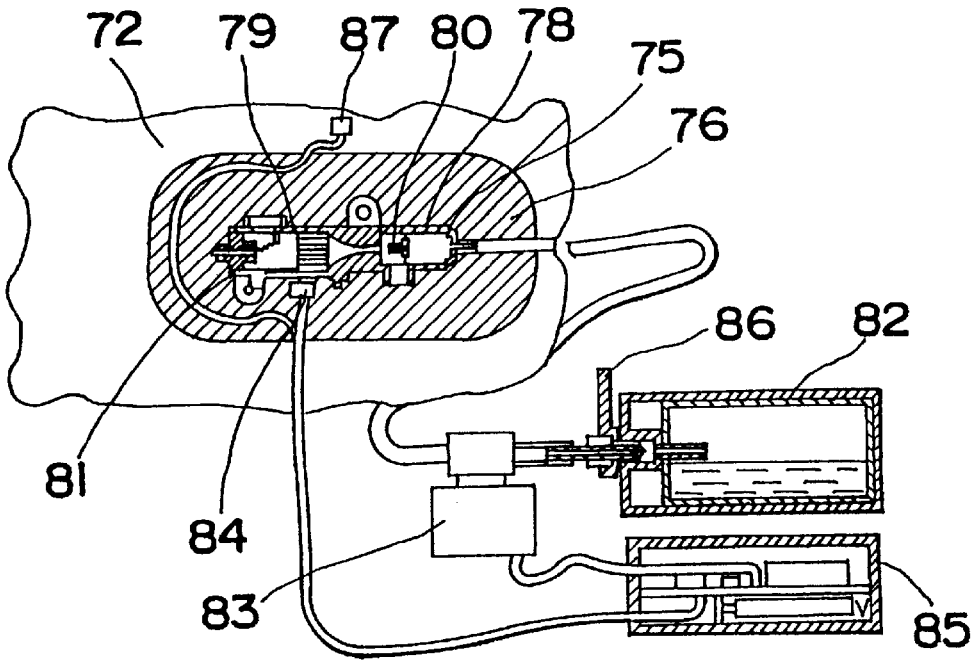
FIG. 21 is a schematic sectional view showing a modification of the eighth embodiment of the present invention.

Eighth Embodiment—FIGS. 20 and 21

An eighth embodiment of the present invention will be described with particular reference to FIG. 20 which illustrates only the structure of the heat source. In this figure, reference numeral 78 represents a catalytic combustor, reference numeral 79 represents a combustion catalyst, reference numeral 80 represents a gas injection nozzle, and reference numeral 81 represents an ignitor utilizing a discharge. Reference numeral 82 represents a fuel container from which a gaseous fuel is supplied to the gas injection nozzle 80 through an electromagnetic valve 83. Reference numeral 84 represents a temperature sensor utilizing a heat responsive element such as a thermistor. The temperature sensor 84 is mounted on the catalytic combustor 78. A controller 85 for controlling the electromagnetic valve in response to a signal from the temperature sensor 84 is so designed as to close the electromagnetic valve 83 when the temperature of the catalytic combustor 78 attains a value equal to or higher than 180° C. Reference numeral 86 represents a sluice valve such as a needle valve.

When the sluice valve 86 is opened to allow the gaseous fuel to be injected from the gas injection nozzle 80 and the injected gaseous fuel is subsequently ignited, combustion takes place accompanied by flames. The combustion catalyst 79 is then heated by the combustion heat and, when the temperature of the combustion catalyst 79 attains a value equal to or higher than 200° C. at which catalytic combustion is generally initiated, the catalytic combustion takes place. As a result of the start of the catalytic combustion, the amount of the gaseous fuel used in the combustion decreases, with the flames eventually disappearing. The temperature of the catalytic combustor 78 increases. Air inside the heat insulating casing 74 is heated, resulting in generation of the ascending current. The heated air is discharged through the convection paths 73 and then flows upwardly in the gap between the human back 77 and the inner back 72 of the clothing. At this time, the heated air warms the human back 77. When the temperature of the catalytic combustor 78 attains a value equal to or higher than 180° C., the electromagnetic valve 83 is closed to interrupt the supply of the gaseous fuel to thereby prevent an abnormal temperature increase.

Although in the embodiment shown in FIG. 20 the temperature sensor 84 is fitted to the catalytic combustor 78 to detect the temperature thereof, the temperature sensor may be fitted to the inner back 72 of the clothing as shown by 87 in FIG. 21 so that the temperature inside the clothing can be detected and be transmitted to the controller 85. In such case, the heated air discharged through the convection paths 73 can warm the human back 77 and, when the temperature sensor 87 detects the temperature equal to or higher than 37° C., the controller 85 operates in response to a signal from the temperature 87 to close the electromagnetic valve 83 to thereby interrupt the supply of the gaseous fuel, but when the temperature sensor 87 detects the temperature equal to or lower than 27° C., the controller 85 operates to open the electromagnetic valve 83 to initiate the supply of the gaseous fuel again so that the temperature at the inner back 72 of the clothing can be kept at a comfortable temperature of 32° C.

Figure 22:
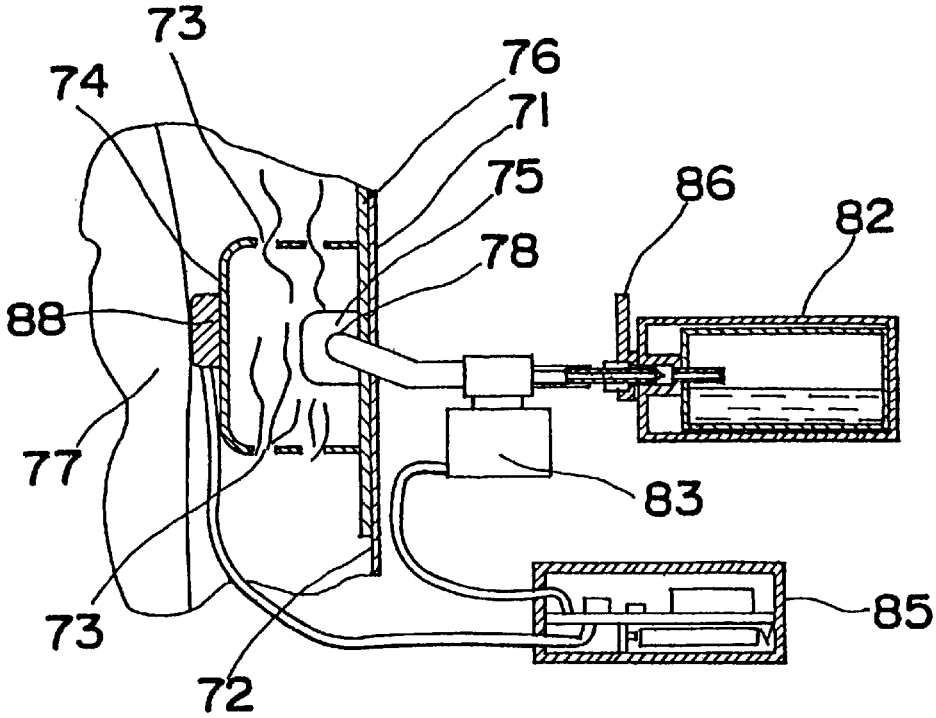
FIG. 22 is a fragmentary sectional view of the heater-incorporated cloth according to a ninth embodiment of the present invention.

Ninth Embodiment—FIG. 22

The ninth embodiment of the present invention shown in FIG. 22 is substantially identical with that shown in FIG. 20, except for the use of a temperature sensor 88. This temperature sensor 88 is a heat responsive element such as a thermistor and is fitted to the heat insulating casing 74 at a location between the heat insulating casing 74 and the human back 77. The controller 85 is so designed as to selectively open and close the electromagnetic valve 83 when the temperature detected by the temperature sensor 88 attains a value within the range of 31 to 33° C. so that the temperature of the human back 77 can be heated to a temperature approximating to 32° C. at which the human living is believed to feel comfortable.

The function of the device according to the embodiment of FIG. 22 is substantially similar to that of the device shown in FIG. 20 and the heated air warms the human back 77. However, when the temperature detected by temperature sensor 88 attains a value higher than 33° C., the controller 85 closes the electromagnetic valve 83 to interrupt the supply of the gaseous fuel, but when the temperature detected by the temperature sensor 88 attains a value lower than 31° C, the electromagnetic valve 83 is opened to restart the supply of the gaseous fuel. In this way, the temperature around the human back 77 can be maintained substantially at 32° C. at which the human being generally feels comfortable.

Figure 23:
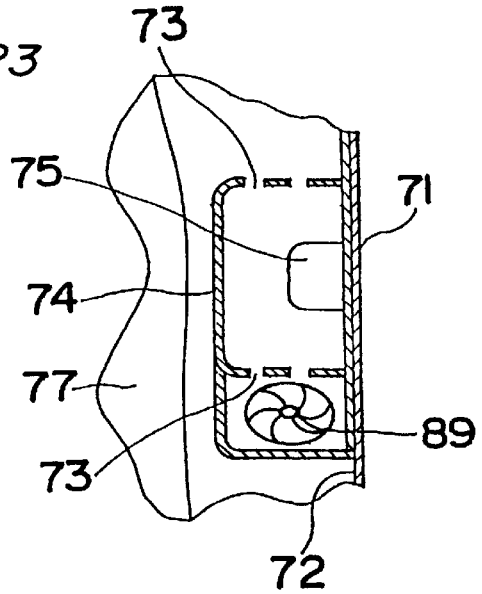
FIGS. 23 and 24 are fragmentary sectional views of the heater according to tenth and eleventh embodiments of the present invention, respectively.

Tenth Embodiment—FIG. 23

The tenth embodiment of the present invention is shown in FIG. 23. In FIG. 23, reference numeral 71 represents a clothing. Reference numeral 72 represents an inner back of the clothing 71 to which a heat source 75 wrapped by a heat insulating casing 74 having convection paths 73 defined therein is fitted through a fitting member 76. High heat conductive fibers such as copper fibers may be used in the fitting member 76 to facilitate radiation of heat from the heat source 75. Also, the heat source 75 may be wither a body warmer or a chemical heating material. The heat insulating casing 74 is made of a heat resistant synthetic resin such as, for example, nylon and serves to avoid a contact between the heat source 75 and the back 77 of the user when the latter wears the clothing 71 on. Since the heat insulating casing 74 forms a gap between the back 77 of the wearer and the inner back 72 of the clothing. Reference numeral 89 represents a fan disposed below the heat source 75. The fan 89 serves to supply air into the interior of the heat insulating casing 74 through the convection paths 73 positioned therebelow. The air so supplied into the interior of the heat insulating casing 74 absorbs heat from the heat source 75 and is then discharged through the convection paths 73, positioned thereabove, so as to flow upwardly through the gap. At this time, the heated air warms the human back 77. In this way, design has been made that the heated air can be moved by a forced draft system to accomplish heating.

Figure 24:
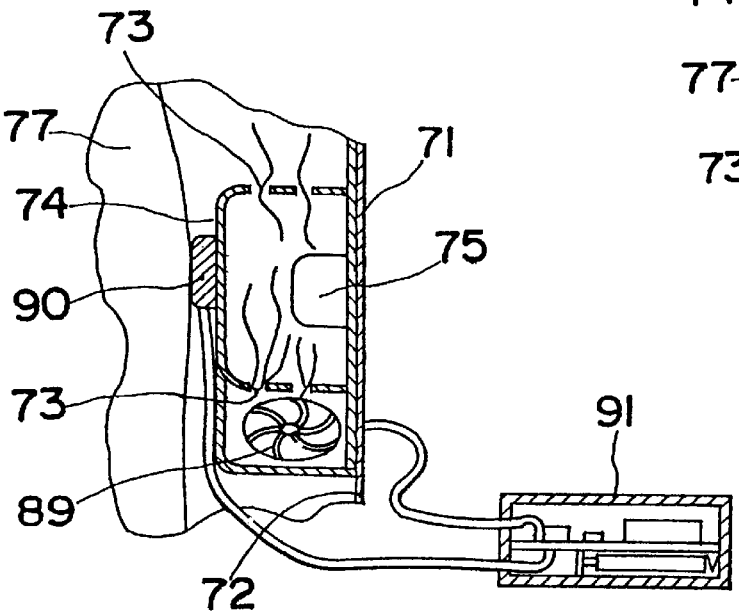

Eleventh Embodiment—FIG. 24

The eleventh embodiment of the present invention is shown in FIG. 24 in which reference numeral 71 represents a clothing. Reference numeral 72 represents an inner back of the clothing 71 to which a heat source 75 wrapped by a heat insulating casing 74 having convection paths 73 defined therein is fitted through a fitting member 76. High heat conductive fibers such as copper fibers may be used in the fitting member 76 to facilitate radiation of heat from the heat source 75. Also, the heat source 75 may be wither a body warmer or a chemical heating material. The heat insulating casing 74 is made of a heat resistant synthetic resin such as, for example, nylon and serves to avoid a contact between the heat source 75 and the back 77 of the user when the latter wears the clothing 71 on. Since the heat insulating casing 74 forms a gap between the back 77 of the wearer and the inner back 72 of the clothing. Reference numeral 89 represents a fan disposed below the heat source 75. A temperature sensor 90 of a type utilizing a heat responsive element such as a thermistor is fitted to the heat insulating casing 74 at a position between the human back 77 and the heat insulating casing 74. Reference numeral 91 represents a controller operable in response to a signal from the temperature sensor 90 to control the flow of air produced by the fan 89. The fan 89 serves to supply air into the interior of the heat insulating casing 74 through the convection paths 73 positioned therebelow. The air so supplied into the interior of the heat insulating casing 74 absorbs heat from the heat source 75 and is then discharged through the convection paths 73, positioned thereabove, so as to flow upwardly through the gap. At this time, the heated air warms the human back 77. Since at the start of heating the temperature inside the clothing is low, the draft of air is lowered to allow the temperature of the heated air to increase. As the heating proceeds, the temperature inside the clothing 71 increases and, when the temperature detected by the temperature sensor attains a value higher than 33° C., the draft of air is increased to lower the temperature of the heated air so that the temperature inside the clothing 71 can be maintained at a comfortable temperature.

Figure 25:
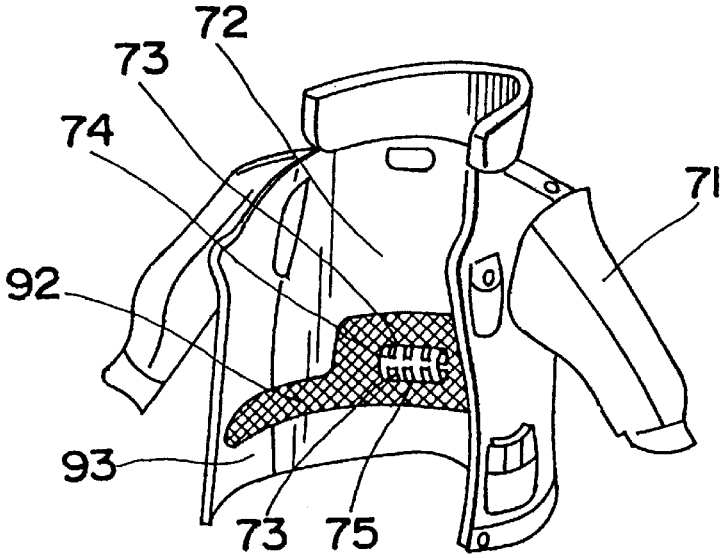
FIG. 25 is a schematic perspective view of the heater-incorporated cloth according to a twelfth embodiment of the present invention.
Figure 26:
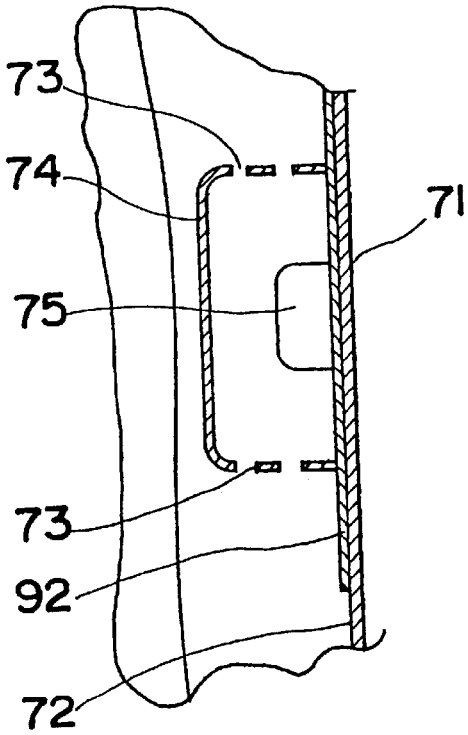
FIG. 26 is a sectional view, on an enlarged scale, of the heater used in the heater-incorporated cloth of FIG. 25.

Twelfth Embodiment—FIGS. 25 and 26

The twelfth embodiment of the present invention will now be described with reference to FIGS. 25 and 26. FIGS. 25 and 26 illustrate an outer appearance of the heater-incorporated cloth and the section of the heat source unit. In these figures, reference numeral 71 represents a clothing. Reference numeral 72 represents an inner back of the clothing 71 to which a heat source 75 covered by a heat insulating casing 74 is fitted through a heat radiating member 92. The heat radiating member 92 may be made of highly heat conductive fibers such as copper fibers to facilitate heat conduction. This heat radiating member 92 so fitted to the inner back 71 of the clothing 71 has its opposite end portions extending to an inner front 93 of the clothing. The heat insulating casing 74 is made of a heat resistant synthetic resin such as, for example, nylon and serves to avoid a contact between the heat source 75 and the back 77 of the user when the latter wears the clothing 71. The heat insulating casing 74 is protruding so as to form a gap between the back 77 of the wearer and the inner back 72 of the clothing. When the heat source 75 heats air inside the heat insulating casing 74, an ascending current is generated and heated air is discharged through convection paths 73 so as to flow upwardly through the gap. At this time, the heated air heats the back 77 of the wearer. On the other hand, the heat radiating member 92 acts to conduct the heat to the front 93 of the clothing to heat a front portion of the wearer. In this way, this embodiment of the present invention is so structured as to warm the wearer by the utilization of heat convection and conduction.

Figure 27:
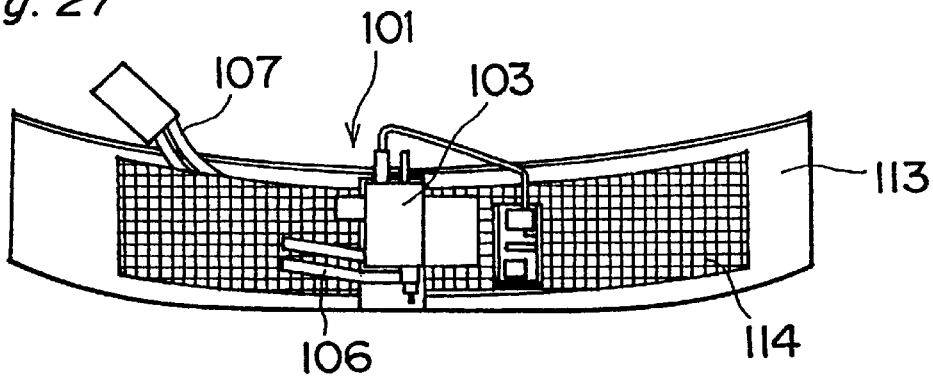
FIG. 27 is a schematic plan view showing the heater and an heat insulating band carrying the heater in the heater-incorporated cloth according to a thirteenth embodiment of the present invention.
Figure 28:
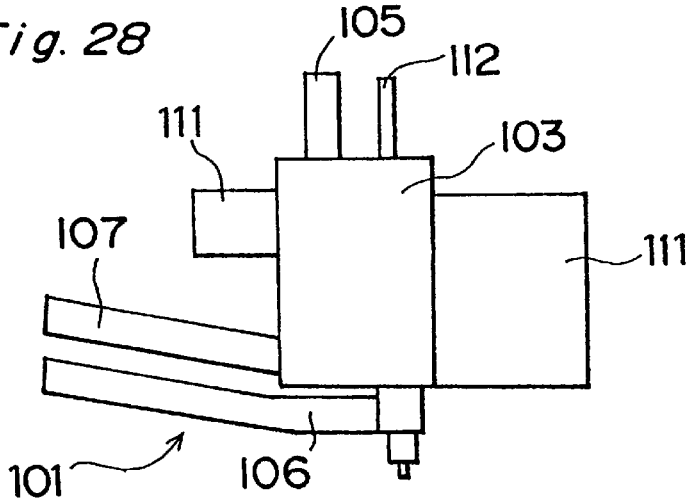
FIG. 28 is a schematic plan view showing an outer appearance of the heater shown in FIG. 27.
Figure 29:
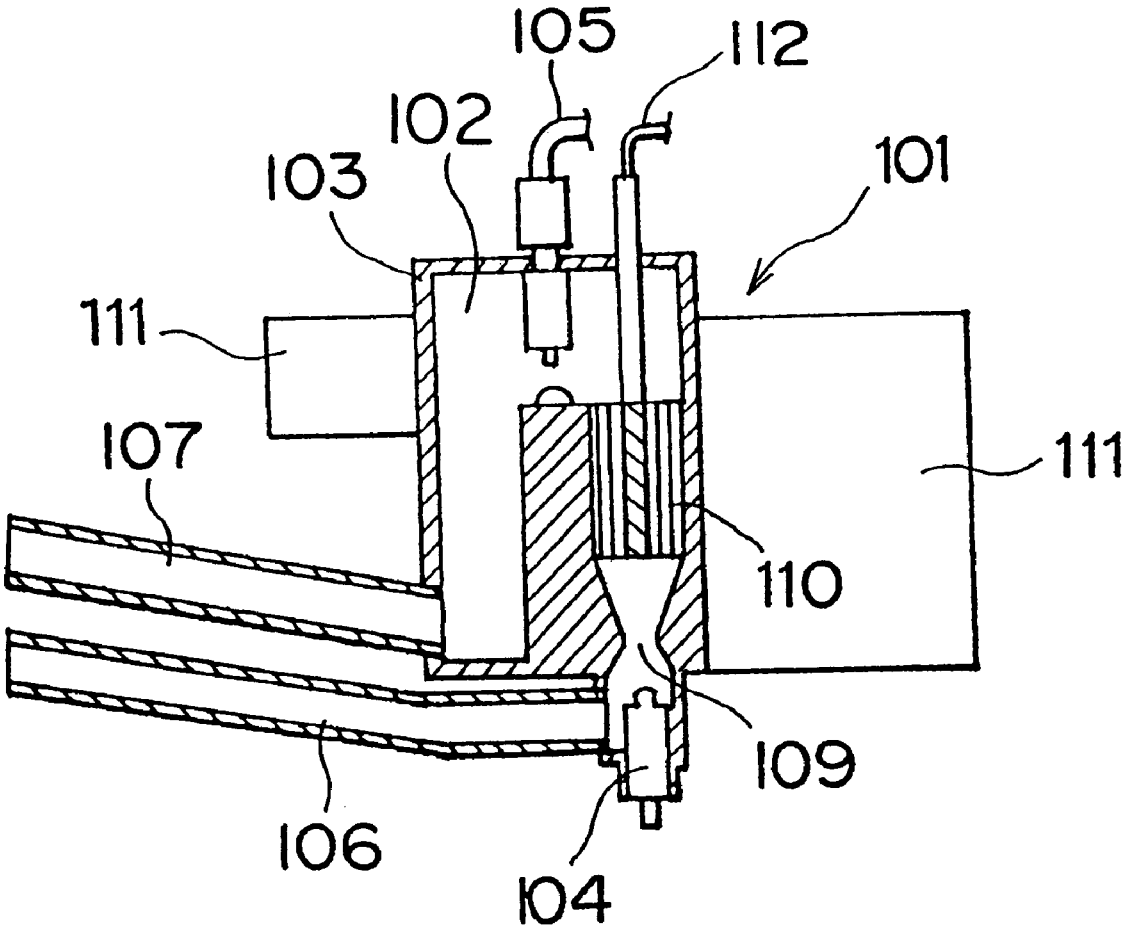
FIG. 29 is a schematic sectional view of the heater shown in FIG. 27.

Thirteenth Embodiment—FIGS. 27 to 29

The heater-incorporated garment according to a thirteenth embodiment of the present invention will be described with reference to FIGS. 27 to 29. The garment shown in connection with this embodiment is a clothing identical with that shown in FIG. 25. According to this embodiment of the present invention, as best shown in FIG. 25, a heater 101 of a catalytic combustion type is fitted to inside the clothing 71, the details of which heater 101 are shown in FIGS. 27 to 29.

The catalytic combustion type heater 101 comprises a housing 103 having a combustion chamber 102 defined therein, a fuel injection nozzle 104 fluid-connected with a fuel source and disposed in the combustion chamber 102, an ignitor including an ignition terminal 105 disposed in the combustion chamber 102 for igniting fuel supplied into the combustion chamber 102, a flexible air intake tube 106 for introducing air to a position adjacent the fuel injection nozzle 104 so as to mix with the fuel injected from the fuel injection nozzle 104, and a flexible exhaust tube 107 for discharging an exhaust gas, formed as a result of combustion of the fuel, from the combustion chamber 102 to the outside. The fuel source comprises a container receptacle including the sluice valve 30 and the sluice knob 29 as shown in FIG. 9 and is so designed that when a pressurized fuel container filled with butane in a liquid phase is loaded in the container receptacle and the sluice knob 29 is subsequently manipulated, the fuel can be supplied therefrom the fuel injection nozzle 104 through a flexible fuel supply tube.

The catalytic combustion type heater 101 is so designed and so configured that when the fuel is supplied to the nozzle 104 in the manner described above, the fuel flowing through an ejector 109 is mixed with air introduced through the air intake tube 106 to thereby form an air-fuel mixture which is subsequently ignited by a spark discharge emitted from the ignition terminal 105. A catalyst 110 is disposed between the combustion chamber 102 and the nozzle 104 to facilitate a catalytic combustion of the air-fuel mixture. The exhaust gas formed as a result of the combustion is discharged to the outside through the flexible exhaust tube 107.

The housing 103 is heated by the effect of combustion taking place within the combustion chamber 102. To facilitate heat radiation from the housing 103 so heated, not only is the housing 103 made of a metallic material having a high thermal conductivity, but also a plurality of heat radiating fins 111 are secured to, or formed integrally with, the housing 103 so as to extend laterally outwardly therefrom.

Considering that according to the thirteenth embodiment of the present invention the catalytic combustion type heater 101 is fitted to a portion of the inner back of the clothing 71 which is generally aligned with a lower region of the spine, all of the fuel supply tube leading to the nozzle 104, the air intake tube 106, the exhaust tube 107 and electric lines of the ignitor connected with the ignition terminal 103 are preferably made of a material having a relatively high flexibility so that they will not constitute an obstruction to free movement of the wearer. It is to be noted that the fuel source including the fuel container and a battery forming an electric power source for the ignitor may be accommodated within a pocket of the clothing 71. Respective free open ends of the air intake and exhaust tubes 106 and 107 are communicated with the outside through a mesh fabric stitched to an appropriate portion of the clothing 71.

Reference numeral 112 represents a temperature sensor substantially identical in structure and function with the temperature sensor 84 shown in FIG. 20. This temperature sensor 112 is preferably employed in the form of a thermistor.

The catalytic combustion type heater 102 of the type discussed above is fitted firmly to a heat insulating band 113 made of, for example, felt as shown in FIG. 27. In order for the heat transmitted from the housing 103 to the radiating fins 111 to uniformly warm a substantially entire area of the wearer's back, a band-shaped heat conducting member 114 is preferably interposed between the heater 101 and the heat insulating band 114. This band-shaped heat conducting member 114 may be a heat conducting textile fabric which may be, for example, a woven fabric woven by the use of aluminum-plated glass yarns having a high heat diffusion property, a woven fabric containing carbon fibers, a woven fabric containing natural or synthetic yarns formed with a layer of metallic particles dispersed in a flexible resinous binder, a woven fabric made up of metallic fibers, or a woven fabric woven by the use of metallic fibers and fibers other than the metallic fibers, as is the case with the heating sheet discussed hereinbefore. Preferably, the heat conducting textile fabric is in the form of a woven fabric made up of one of polyester and copper threads forming a weft and the other of the polyester and copper threads forming a warp.

The heat insulating band 113 having the heater 101 fitted thereto is releasably fitted to an inner back of the clothing 71. For this purpose, as a releasable fitting means, a flexible planar fastener available under "Velcro®" may be stitched to one of opposite surfaces of the heat insulating band 113 opposite to the heater 101, or a zipper may be stitched along a peripheral edge of the heat insulating band 113. Alternatively, the heat insulating band 113 may be stitched to the clothing 71, in which case only the heater 101 may be separable from the heat insulating band 113.

Thus, it is clear that even the thirteenth embodiment of the present invention shown in FIGS. 27 to 29 can provide a comfortable heating as is the case with any one of the foregoing embodiments of the present invention.

It is to be noted that in the practice of the thirteenth embodiment of the present invention the clothing may be a jacket, a coat, an overcoat or the like. It is noted that not only may the clothing be manufactured with the heater incorporated therein, the heat insulating band with the heater secured thereto can be fitted to any existing cloth and in such case, an extra pocket having its mouth adapted to be closed by a zipper or a flexible planar fastener may be formed in an inner layer of the clothing for accommodating the heater together with the heat insulating band.

What is claimed is:

1. A heating garment which comprises:

a combustor including a fuel tank and a combustion unit, said combustor being fitted to a portion of the garment which corresponds to a lower back region of a wearer of the garment and positioned between textile layers forming the garment; and a heat conducting path for transmitting air, heated by the combustor, upwardly of the garment between the textile layers.

2. The garment as claimed in claim 1, wherein the combustor includes a casing having at least one top opening and at least one bottom opening, and the heat transmitting path including a passage communicating the top and bottom openings together.

3. The garment as claimed in claim 1, further comprising a heat conductive member extending from the combustor in a lateral direction generally perpendicular to a spine of the wearer.

4. The garment as claimed in claim 3, wherein the heat conductive member is made of graphite.

5. The garment as claimed in claim 4, wherein the heat conductive member is fitted to a back of the garment, and further comprising a heat insulating material interposed between the heat conductive member and the wearer.

6. The garment as claimed in any one of claims 1 to 5, wherein the combustor comprises a heat source including a combustion catalyst and an igniting device.

7. The garment as claimed in claim 1, further comprising a heat generating unit including a plurality of heat radiating fins.

8. The garment as claimed in claim 7, wherein the combustor comprises a housing constituted by the heat generating unit and having a combustion chamber defined therein; a fuel injection nozzle fluid-connected with a fuel supply source and disposed in the combustion chamber; an ignitor disposed in the combustion chamber for igniting fuel supplied into the combustion chamber; an air intake tube for introducing air from an outside to a position adjacent the injection nozzle for mixing with the fuel, injected by the injection nozzle, to form an air-fuel mixture; and exhaust tube for exhausting an exhaust gas, produced as a result of combustion of the air-fuel mixture, to an outside of the garment.

9. The garment as claimed in claim 8, further comprising a catalyst disposed in a portion of the combustion chamber downstream of the injection nozzle with respect to the direction of flow of the fuel injected from the injection nozzle.

10. The garment as claimed in claim 3, wherein the heat conductive member is made of a heat conductive textile fabric.

11. The garment as claimed in claim 10, wherein the heat conductive textile fabric is a woven fabric made up of one of polyester and copper threads forming a weft and the other of the polyester and copper threads forming a warp.

12. A combustor which comprises:

a heat source unit including a burner and an ignitor and a casing accommodating the burner and the ignitor therein, said casing being covered by a heat insulating case having a convection passage defined therein;

a heating sheet made of a heat conductive material and extending outwardly from at least one side of the casing; and a fibrous layer of a high heat insulating property joined to the heat source unit and at least one side of the heating sheet.

13. The combustor as claimed in claim 12, wherein the heat source unit is joined to at least a portion of the heating sheet through a heat conductive material selected from the group consisting of a heat conductive compound and a thermo-grease.

14. The combustor as claimed in claim 12, wherein a plurality of projections are provided on a surface of contact between the heat source unit and the heating sheet and wherein heat conductive fibers are woven in the form as twined around the projections.

15. The combustor as claimed in claim 12, further comprising a retaining base made of metal of a high thermal conductivity, that is selected from the group consisting of copper and aluminum, and wherein the heat source unit is pressed to the heating sheet through the retaining base.

16. The combustor as claimed in claim 12, further comprising a temperature sensor for detecting a temperature of the heating sheet; a control valve for adjusting a gas flow; and a controller operable in response to a signal from the temperature sensor to control the control valve.

17. The combustor as claimed in claim 12, further comprising a burner used as a combustion catalyst.

* * * * *